United States Patent [19]

Pilgrim

[11] Patent Number: 4,695,060

[45] Date of Patent: Sep. 22, 1987

[54] REVERSIBLE ARCHERY TARGET

[76] Inventor: J. Cole Pilgrim, 3706 Clear Falls Dr., Kingwood, Tex. 77339

[21] Appl. No.: 858,956

[22] Filed: May 2, 1986

[51] Int. Cl.[4] ..... F41J 3/00

[52] U.S. Cl. ..... 273/404; 273/407

[58] Field of Search ..... 273/404, 407, 408, 409

[56] References Cited

U.S. PATENT DOCUMENTS

| | | | |
|---|---|---|---|
| 2,812,947 | 11/1957 | Fatzinger et al. | 273/404 |
| 2,958,500 | 11/1960 | Saunders | 273/407 X |
| 3,244,419 | 4/1966 | Lerman | 273/409 X |
| 3,367,660 | 2/1968 | Di Maggio | 273/404 |
| 4,076,246 | 2/1978 | Meyer | 273/408 X |
| 4,456,264 | 6/1984 | Detwiler | 273/404 |

FOREIGN PATENT DOCUMENTS

| | | | |
|---|---|---|---|
| 2932778 | 3/1981 | Fed. Rep. of Germany | 273/404 |
| 2560981 | 9/1985 | France | 273/407 |

OTHER PUBLICATIONS

Archer's Bible, 1966–1967, p. 9, 3–1967, Shorty Stand.
Bow & Arrow Hunting, 4–1986, pp. 64, 65, 68.

*Primary Examiner*—Paul E. Shapiro
*Attorney, Agent, or Firm*—Neal J. Mosely

[57] ABSTRACT

A reversible archery target has a central divider panel of heavy utility grade polypropelyne which divides the interior of the target into two partitions, each filled with cotton material. The exterior covering of the target comprises two layers of light utility grade polypropelyne, and an outer layer of heavy burlap having various target shapes silkscreened on both exterior sides. The target has a dual purpose carrying strap which can also be used to hang the target in suspension. A spring steel stand supports the target on the ground while being unseen and undisturbed from the opposite side.

21 Claims, 5 Drawing Figures

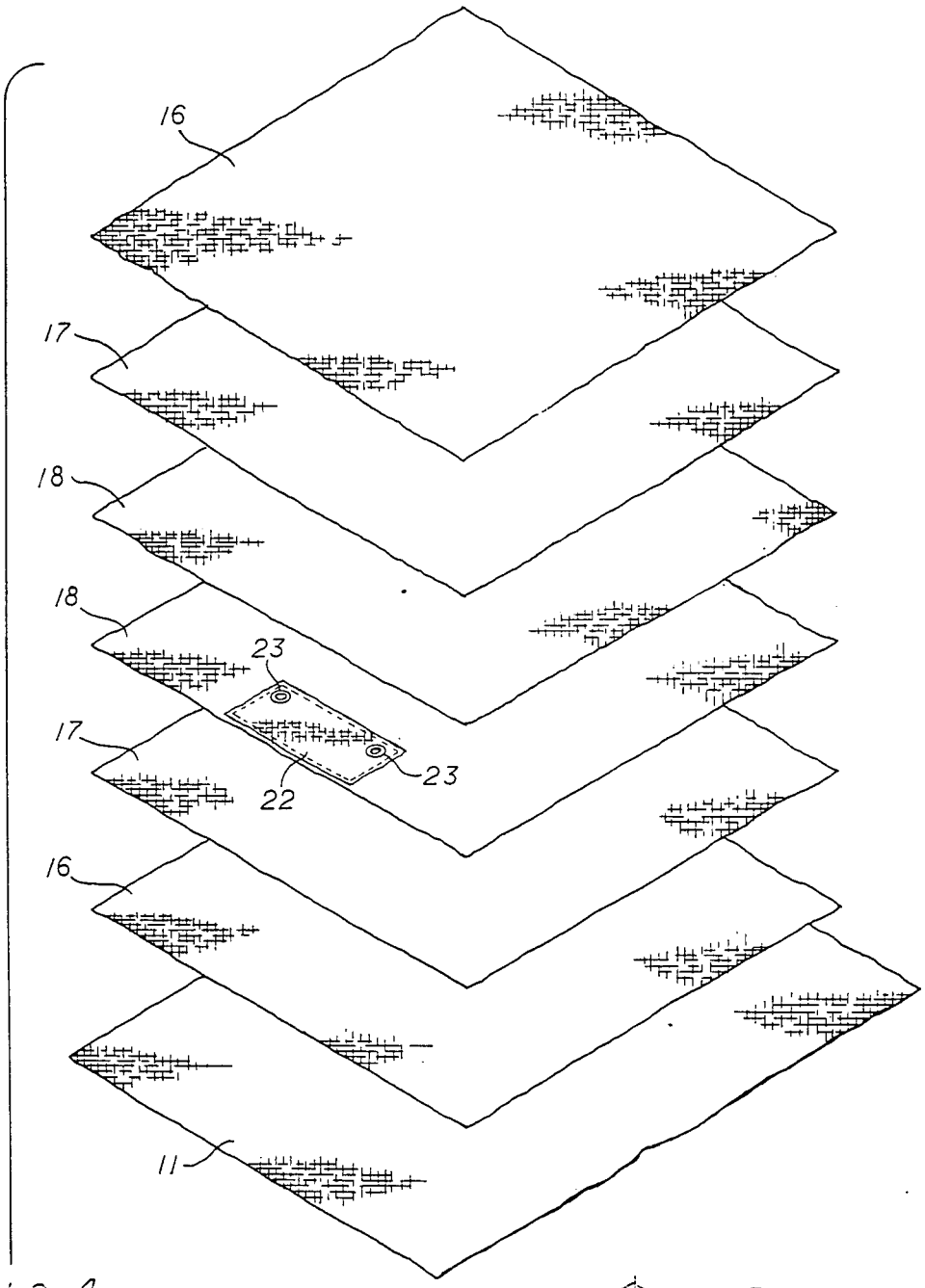
FIG.4
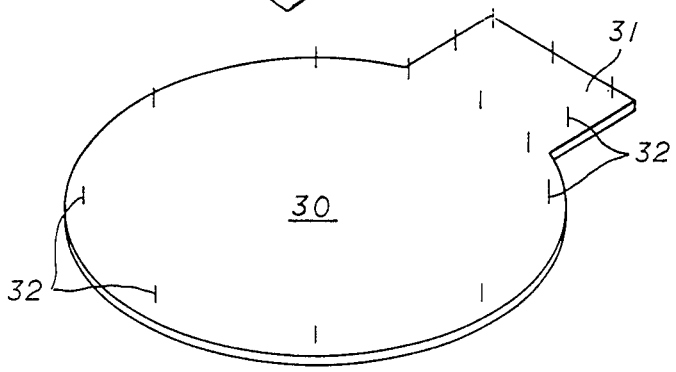

REVERSIBLE ARCHERY TARGET

BACKGROUND OF THE INVENTION

1. FIELD OF THE INVENTION

This invention relates generally to archery targets, and more particularly to a reversible archery target having a central divider panel of polypropelyne which divides the interior of the target into two partitions, each filled with cotton material and an exterior covering of two layers of polypropelyene with an outer layer of heavy burlap having various target shapes on both exterior sides.

2. BRIEF DESCRIPTION OF THE PRIOR ART

Reversible archery targets having a central divider are known in the art. There are several patents which disclose various archery targets with dividers.

Detwiler, U.S. Pat. No. 4,456,264 discloses a compound archery target having a laminated mat or covering comprising an outer layer of burlap, a second layer of burlap, a third layer of vinyl, and a central baffle of fiberglass screen material. The target is filled on each side of the central baffle with loose fiberglass or vinyl scrap material.

Roloff et al, U.S. Pat. No. 3,476,390 discloses a non-piercing archery target comprising a paper face cemented to a cardboard backed up by a second cardboard which abuts a layer of foam rubber which in turn abuts a sheet of rubber. A bag-like layer of burlap covers the elements and its edges are secured between the two cardboards.

Di Maggio, U.S. Pat. No. 3,367,660 discloses an archery target comprising a laminated body of elastically adhesively bonded fibers arranged in a plurality of layers. The layers are formed of a mass of tristed vulcanized rubber created vegetable fibers. Each adjacent layer is separated by a reinforcing screen mesh element which is bonded to the surfaces. The screen mesh is formed of a vulcanized latex coated woven fabric. Nylon fabric barrier sheets are secured between the layers to trap arrows.

Canadian Pat. Nos. 706,287 and 1,022,343 disclose dart boards formed of foamed material and having a wooden backing plate or divider.

The present invention is distinguished over the prior art in general, and these patents in particular by a reversible archery target having a central divider panel of heavy utility grade polypropelyne which divides the interior of the target into two partitions, each filled with cotton material. The exterior covering of the target comprises two layers of light utility grade polypropelyne, and an outer layer of heavy burlap having various target shapes silkscreened on both exterior sides. The target has a dual purpose carrying strap which can also be used to hang the target in suspension. A spring steel stand supports the target on the ground while being unseen and undisturbed from the opposite side.

SUMMARY OF THE INVENTION

It is therefore an object of the present invention to provide an archery target which is durable and will maintain its shape after repeated usage.

It is another object of this invention to provide an archery target constructed of materials having fibers which will separate upon penetration to reduce tearing and cutting caused by the arrows.

Another object of this invention is to provide an archery target which is exceedingly resistant to arrow impact, penetration, and wear and allows easy removal of arrows.

Another object of this invention is to provide a reversible archery target having a handle or carrying strap for portability and which may also be used to hang the target in a suspended position.

Another object of this invention is to provide an archery target which is convenient to set up and use.

A further object of this invention is to provide an archery target having front and back sides whereby both sides of the target may be used satisfactorily.

A still further object of this invention is to provide an archery target which is attractive in appearance, and inexpensive to manufacture.

Other objects of the invention will become apparent from time to time throughout the specification and claims as hereinafter related.

The above noted objects and other objects of the invention are accomplished by a reversible archery target having a central divider panel of polypropelyne which divides the interior of the target into two partitions, each filled with cotton material and an exterior covering of two layers of polypropelyne with an outer layer of heavy burlap having various target shapes on both exterior sides.

BRIEF DESCRIPTION OF THE DRAWINGS

FIG. 4 is an exploded isometric view of the target illustrating the various layers arranged in accordance with the steps of manufacture.

DESCRIPTION OF THE PREFERRED EMBODIMENT

Figure 1:
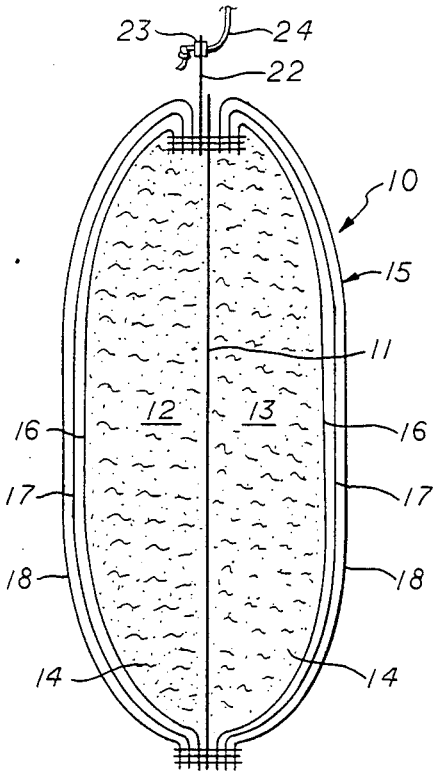
FIG. 1 is a longitudinal cross section view of the archery target in accordance with the present invention.

Referring to the drwings by numerals of reference, there is shown in FIG. 1, a preferred archery target 10 having a central divider 11 of heavy utility grade woven polypropelyne such as #623 Bulk Poly, which divides the interior of the target into two partitions 12 and 13. The partitions 12 and 13 are each filled with approximately 9–10 pounds of cotton material 14 such as ginned processed cotton.

The exterior mat or covering 15 of the target comprises two intermediate layers 16 and 17 of light utility grade woven polypropelyne, such as #610 Rice Poly, and an outer layer 18 of heavy woven burlap, such as 10 ounce burlap fabric. As hereinafter described, the target 10 is compressed to a thickness of approximately four to five inches.

The exterior surface of the burlap 18 is silkscreened to display various target shapes or designs. In the example illustrated, one side of the target 10 is provided with the image of a portion of the body of a white tailed deer 19 with a red "kill" zone 20 outlined at the heart-lung area. The reverse side of the target is provided with a plurality of bullseyes 21 spaced about the target surface. The spaced targets provide for longer target life by preventing the arrow penetration area (area of most usage) from being concentrated in a central location.

A rectangular tongue 22 of heavy utility grade woven polypropelyene such as #623 Bulk Poly extends outwardly from the center of the target at the top end and grommets 23 are installed in the corners. Each end of a short length of polypropelyne rope is inserted through the grommets 23 and knotted to form a dual purpose carrying strap or handle 24 which can also be used to hang the target suspended from the limbs of trees and the like.

Figure 3:
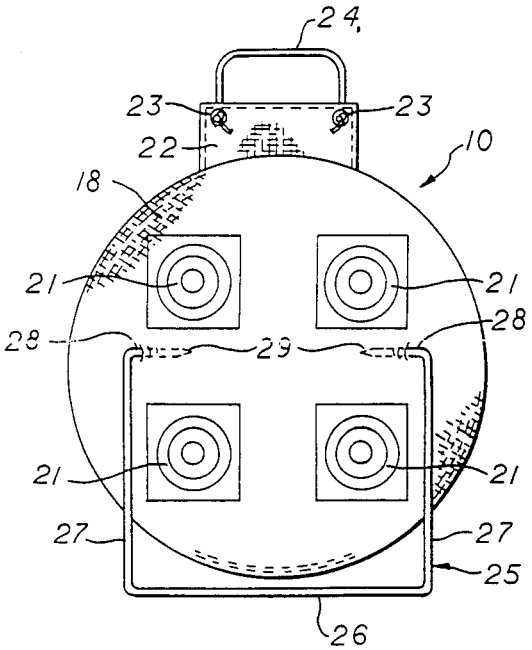
FIG. 3 is an elevation view of the other side of the target of FIG. 2.

As shown in FIG. 3, a generally U-shaped support stand 25 is provided to support the target 10 on the ground of other flat surface. The stand 25 is preferably constructed of a length of high carbon load reinforcing steel having good spring retention characteristics bent to form a horizontal base portion 26 and a pair of opposed sidebars 27 extending perpendicular thereto. The upper ends of the sidebars 27 are bent inwardly parallel to the horizontal base to form a pair of opposed short horizontal bars 28 terminating in sharpened points 29. To install the stand 25, the sidebars 27 are pulled apart and the points are placed against the surface of one side of the target, then released allowing the points 29 to penetrate the target covering. In this manner, the stand is pivotally attached to one side of the target to support the target in a substantial upright balanced position while being unseen and undisturbed from the opposite side.

It should be understood that the target in accordance with the present invention may be constructed in a variety of shapes, including square and animal shapes, and carry various target designs on the exterior surface.

The layered woven burlap and polypropelyne fabric material makes an excellent covering for archery targets. The woven fabric allows the weave to part as projectiles penetrate it, therefore reducing the likelihood of tearing and cutting and extend the life of the target. The polypropylene is also weather resistant protect the cotton filler material and add to target life.

The cotton material is a natural buffer. The cotton fibers bond together and "ball up" on the ends of pointed objects as they attempt to penetrate. The frictional properties of the cotton fibers against the shaft of the arrow as it penetrates effectively grip the shaft of the arrow as it moves in allowing only penetration of approximately 1½–2 inches. The grip is relaxed after the arrow has stopped and the arrow is easily pulled from the material.

The target in accordance with the present invention is weather resistant and very durable. The central divider 11 aids in maintaining the shape of the target by providing two compartments to prevent the cotton stuffing from collecting in one large area. It also acts as a semi-flexible backstop or buffer to reinforce the shock abosrbing characteristics of the cotton. The target will last for thousands of shots and allows the archer to remove his arrows easily with two fingers. The target can also be renewed by simply removing the cotton filler from the old target and stuffing it inside a new target covering.

Method of Manufacture

Figure 2:
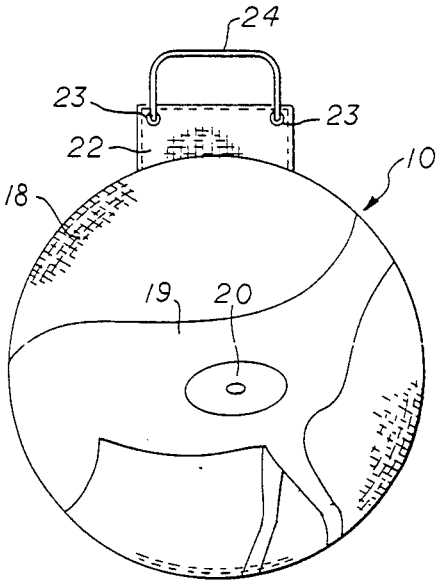
FIG. 2 is an elevation view of one side of the target.

As shown in FIG. 4, the target 10 is assembled on a round table or jig 30 constructed of ¾" plywood having a 30" diameter with a 6"×12" rectangular neck on one end (for the embodiment of FIGS. 2 and 3). A plurality of nails surround the outer periphery of the table or jig with the points facing upwardly to position the burlap and polypropylene material as it is sewn. The material may be precut into a square, rectangular, or semi-round shape before it is placed over the nails and sewn.

A sheet of the heavy utility grade woven polypropelyne (#623 Bulk Poly) material 11 cut to approximately 36"×42" is placed on the jig 30 in the approximate center allowing approximately a 3" overhang around the outer edge and neck xx and it is pressed down on the nails xx.

Two sheets 16 and 17 of light utility grade woven polypropelyne (#610 Rice Poly) cut to approximately 36"×36" are overlayed over the first sheet 11 with the bottom approximately 2" to 3" above the neck of the table or jig and pressed down over the nails.

A sheet 18 of heavy woven burlap (10 ounce) burlap fabric cut to approximately 36"×36" is overlayed over the sheets 16 and 17 with the silkscreened design (deer body) facing up and pressed down over the nails.

The rectangular tongue 22 of heavy utility grade woven polypropelyne (#623 Bulk Poly) having the grommets 23 installed previously is placed within the nail jig in diametrically opposed position to the neck portion with the grommeted edge inward and the opposed edge extending beyond the periphery of the jig.

A second sheet 18 of heavy woven (10 ounce) burlap fabric cut to approximately 36"×36" is overlayed over the previously installed burlap sheet (deer body) and tongue 22 with the silkscreened design (bullseyes) facing down and pressed down over the nails.

A second pair of sheets 16 and 17 of light utility grade woven polypropelyne (#610 Rice Poly) cut to approximately 36"×36" are overlayed over the burlap sheet 11 with the bottom approximately 2" to 3" above the neck of the table or jig and pressed down over the nails.

The edges of the layers are trimmed evenly around the outer edge of the table with shears and the scraps are discarded.

The layers are then sewn together just inside the outer periphery using a suitable heavy duty weather resistant thread such as Unisac Synthetic. The neck portion is not sewn at this time to allow for filling. It is preferred to sew the edges three times around for strength and durability.

Figure 5:
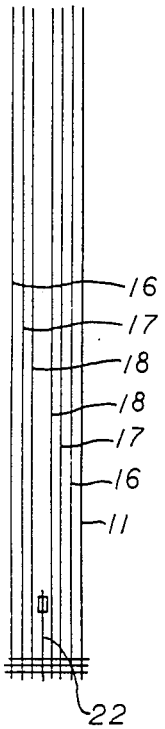
FIG. 5 is a longitudinal cross section view of the archery target in a semi-finished assembled condition.

The target covering is removed from jig by lifting it up and is now in the shape of a bag enclosure as shown in FIG. 5. The hand is inserted into the bag grasping the grommeted edge of the tongue and pulling the bag inside out.

To complete the bag-like covering, each end of a short length of rope (preferably poly-propelyne) is inserted through the grommets of the tongue and knotted to form a dual purpose carrying strap or handle 24.

A shipping bag (not shown) for the target is formed in a similar manner by placing two sheets of light utility grade woven polypropelyne (#610 Rice Poly) cut to approximately 36"×36" are placed in the jig and pressed down over the nails, then the edges are trimmed evenly around the outer edge of the table with shears and the scraps are discarded. The two sheets are then sewn together just inside the outer periphery using a suitable heavy duty weather resistant thread such as Unisac Synthetic. The neck portion is not sewn at this time. The shipping bag is removed from jig by lifting it up. The hand is inserted into the bag grasping the bottom seam and pulling the bag inside out.

After the shipping bag is formed, the competed target covering is placed inside the shipping bag with both neck portions together. At the neck portion, seven plys of the target covering are visible. The center ply will be the central divider 11 of the heavy utility grade woven polypropelyene (#623 Bulk Poly) material. Holding the central divider, 9–10 pounds of cotton material is stuffed on each side of it.

The stuffed target is then placed in a hydraulic press and compressed to a thickness of 4"–5". While the target is under compression, the plys at the neck of the target covering only (not the shipping bag) is sewn closed making three passes using a suitable heavy duty weather resistant thread such as Unisac Synthetic. The completed target in the shipping bag is then removed from the press. The target stand is inserted between the target and the shipping bag to complete the package.

While this invention has been described fully and completely with special emphasis upon a preferred embodiment, it should be understood that within the scope of the appended claims the invention may be practiced otherwise than as specifically described herein.

I claim:

1. An archery target comprising a first layer of burlap, a second layer of woven polypropelyne, a third layer of woven polypropelyne, a fourth layer of woven polypropelyne which is a centrally disposed divider, a fifth layer of woven polypropelyne, a sixth layer of woven polypropelyne, a seventh layer of burlap, said third and fifth layers forming adjacent compartments at each side of said fourth layer, and a mass of fibrous material disposed in said compartments between said third and fourth layer and said fourth and fifth layer, said layers being stitched together about the margins thereof.

2. An archery target according to claim 1 including a rectangular tongue member of woven polypropelyne interposed and secured between said layers having one side extending outwardly therefrom and having grommets secured near the corners thereof.

3. The archery target according to claim 2 including a length of rope having each end inserted through the grommets of said tongue member and knotted to form a dual purpose carrying strap or handle for transporting or suspending said target.

4. An archery target according to claim 1 wherein said target and said mass of fibrous material is compressed after assembly to a predetermined thickness.

5. An archery target according to claim 1 wherein the exterior surface of each said burlap layer displays a target design.

6. An archery target according to claim 1 wherein said mass of fibrous material comprises processed cotton.

7. An archery target according to claim 1 wherein said second and sixth layer of woven polypropelyne comprises light utility grade woven polypropelyne.

8. An archery target according to claim 1 wherein said third and fifth layer of woven polypropelyne comprises light utility grade woven polypropelyne.

9. An archery target according to claim 1 wherein said fourth layer of woven polypropelyne forming a centrally disposed divider comprises heavy utility grade woven polypropelyne.

10. An archery target according to claim 1 wherein said mass of fibrous material comprises processed cotton, and said second and sixth layer of woven polypropelyne comprises light utility grade woven polypropelyne.

11. An archery target according to claim 10 wherein said fourth layer of woven polypropelyne forming a centrally disposed divider comprises heavy utility grade woven polypropelyne.

12. An archery target according to claim 11 wherein said fourth layer of woven polypropelyne forming a centrally disposed divider comprises heavy utility grade woven polypropelyne.

13. An archery target according to claim 1 wherein said mass of fibrous material comprises processed cotton, and said third and fifth layer of woven polypropelyne comprises light utility grade woven polypropelyne.

14. An archery target according to claim 1 wherein said mass of fibrous material comprises processed cotton, and said second, third, fifth, and sixth layer of woven polypropelyne comprises light utility grade woven polypropelyne.

15. An archery target according to claim 14 wherein said fourth layer of woven polypropelyne forming a centrally disposed divider comprises heavy utility grade woven polypropelyne.

16. An archery target according to claim 1 wherein said mass of fibrous material comprises processed cotton, said second, third, fifth, and sixth layer of woven polypropelyne comprises light utility grade woven polypropelyne, and said fourth layer of woven polypropelyne forming a centrally disposed divider comprises heavy utility grade woven polypropelyne.

17. The archery target according to claim 1 including a generally square U-shaped support stand adapted at its upper ends to be removably and pivotally attached to one side of said target and its other end to rest on a generally flat surface for supporting said target in a substantial vertical position, said stand of a size to be unseen and undisturbed from the opposite side.

18. The archery target according to claim 17 in which said stand is constructed of a length of spring steel bent to form a horizontal base portion and a pair of opposed sidebars extending perpendicular thereto, the upper ends of said sidebars bent inwardly parallel to the horizontal base to form a pair of opposed short horizontal bars terminating in sharpened points, and said stand installed by pulling said sidebars apart and placing them against the surface of one side of said target then releasing them allowing the points to penetrate the target surface.

19. A method of manufacturing an archery target comprising the steps of;

providing an assembly jig having a generally round flat configuaration with a rectangular neck portion extending outwardly on one end and a plurality of thin rodlike pointed projections spaced about the periphery of the jig with the points facing upwardly to removably receive and maintain layers of material in a predetermined position on the jig, precutting a plurality of sheets of material to a size slightly larger than the periphery of the jig, precutting a sheet of material to a rectangular shape and installing grommets in two opposed corners thereof, placing a first sheet of material on said jig in the approximate center with the outer edges extending beyond the periphery of the jig and said neck portion and pressing it down on the projections, placing a second and third sheet of material on said jig in the approximate center overlaying said first sheet with the outer edges extending beyond the diametric periphery of the jig excluding said neck portion and pressing them down on the projections, placing a fourth sheet of material on said jig in the approximate center overlaying said third sheet with the outer edges extending beyond the diametric periphery of the jig excluding said neck portion and pressing it down on the projections, placing the rectangular sheet of material in a position diametrically opposed to the neck portion of said jig overlaying said second, third, and fourth sheets with the grommeted edge inward and the opposed edge extending beyond the periphery of the jig, placing a fifth sheet of material on said jig in the approximate center overlaying said fourth sheet and the inward edge of the rectangular sheet with the outer edges extending beyond the diametric periphery of the jig excluding said neck portion and pressing it down on the projections, placing a sixth and seventh sheet of material on said jig in the approximate center overlaying said fourth sheet with the outer edges extending beyond the diametric periphery of the jig excluding said neck portion and pressing them down on the projections, cutting the edges of the overlayed sheets extending beyond the periphery of said jig, sewing the overlayed sheets together just inside the outer periphery excluding said neck portion to form a generally bag-like enclosure with an open neck for receiving a filler material, removing the bag-like enclosure from the jig by lifting it from the projections and turning the bag-like enclosure inside out, and thereafter said first sheet becoming a central divider sheet extending partially outwardly from the open neck and dividing the bag-like enclosure into two compartments on each side thereof, stuffing a predetermined volume of filler material into each compartment of the bag-like enclosure, compressing the stuffed bag-like enclosure to a predetermined thickness and while under compression sewing the layers of material at the open neck together to securely close the opening and completely enclose the filler material within the bag-like enclosure.

20. The method according to claim 19 comprising the further steps of;

forming a shipping bag for the target after removing the bag-like enclosure from said jig and prior to stuffing it with the filler material by placing an eighth and ninth sheet of material on said jig in the approximate center with the outer edges extending beyond the diametric periphery of the jig excluding said neck portion and pressing them down on the projections, cutting the edges of the overlayed sheets extending beyond the periphery of said jig, sewing the overlayed sheets together just inside the outer periphery excluding said neck portion to form a shipping bag enclosure with an open neck for receiving the previously formed bag-like enclosure, removing the shipping bag enclosure from the jig by lifting it from the projections and turning it inside out, inserting the previously formed bag-like enclosure inside the shipping bag with both neck portions together, and thereafter stuffing a predetermined volume of filler material into each compartment of the bag-like enclosure, compressing the stuffed bag-like enclosure and the surrounding shipping bag to a predetermined thickness and while under compression sewing the only the layers of material of the bag-like enclosure at the open neck together to securely close the opening and completely enclose the filler material within the bag-like enclosure.

21. The method according to claim 19 comprising the further step of inserting and securing each end of a length of rope through the grommets of the rectangular sheet of material to form a carrying strap which may also be used to hang the target suspended from the limbs of trees and the like.

* * * * *